US005343217A

United States Patent [19]

Kim

[11] Patent Number: 5,343,217

[45] Date of Patent: Aug. 30, 1994

[54] METHOD FOR DRIVING A FERROELECTRIC LIQUID CRYSTAL DISPLAYS AND BIAS VOLTAGE CIRCUIT THEREFOR

[75] Inventor: Yeong-ho Kim, Suwon, Rep. of Korea

[73] Assignee: Samsung Electron Devices, Co., Ltd., Kyungki-do, Rep. of Korea

[21] Appl. No.: 4,399

[22] Filed: Jan. 14, 1993

[30] Foreign Application Priority Data

Apr. 30, 1992 [KR] Rep. of Korea ..... 92-7403

[51] Int. Cl.[5] ..... G09G 3/36

[52] U.S. Cl. ..... 345/95; 345/210

[58] Field of Search ..... 345/87, 94, 95, 97, 345/104, 210, 208; 359/56

[56] References Cited

U.S. PATENT DOCUMENTS

| | | | |
|---|---|---|---|
| 4,728,947 | 3/1988 | Ayliffe et al. | 340/805 |
| 4,769,639 | 9/1988 | Kawanura et al. | 340/784 |
| 4,870,398 | 9/1989 | Bos | 340/784 |
| 5,047,757 | 9/1991 | Bone et al. | 340/784 |

FOREIGN PATENT DOCUMENTS 62-45535 9/1987 Japan .

*Primary Examiner*—Richard Hjerpe
*Assistant Examiner*—Lun-Yi Lao
*Attorney, Agent, or Firm*—Lowe, Price, LeBlanc & Becker

[57] ABSTRACT

A ferroelectric liquid crystal display is supplied with voltages by STN driving IC's, and a bias voltage circuit for generating voltages supplied to bias pins of driving IC's is provided. The two composite voltages are supplied to liquid crystal cells during the pixel period and the kinds of composite voltage is five or six. In order to supply these composite voltages to the liquid crystal cells, control signal pins of STN driving IC's are supplied with a signal which is "high" during the first half of pixel period and "low" during the latter half of pixel period, and bias voltage pins are supplied with voltages which should be applied to common electrodes and segment electrodes. The circuit for generating bias voltages such voltages includes a plurality of resistors and two power supplies. Thus, the ferroelectric liquid crystal displays can be economically driven, and the flickering of a picture is decreased.

6 Claims, 7 Drawing Sheets

FIG. 4A
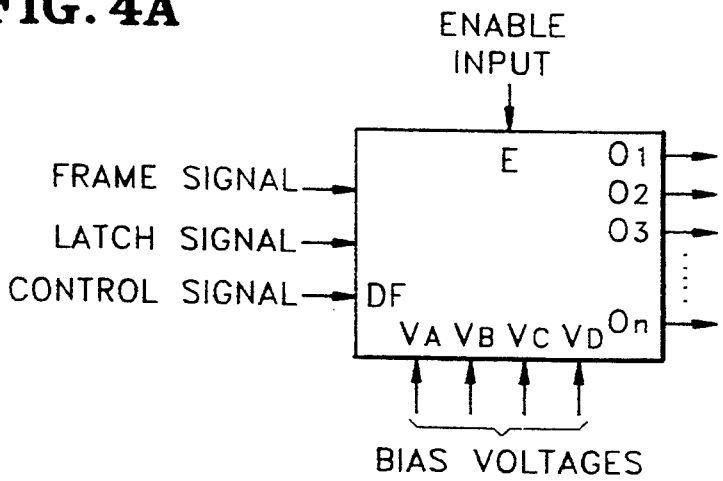
FIG. 4B
| E | DF | STROBE | OUTPUT |
|---|---|---|---|
| H | L | L | VB |
| H | L | H | VD |
| H | H | L | VC |
| H | H | H | VA |
| L | X | X | VB |
FIG. 4C
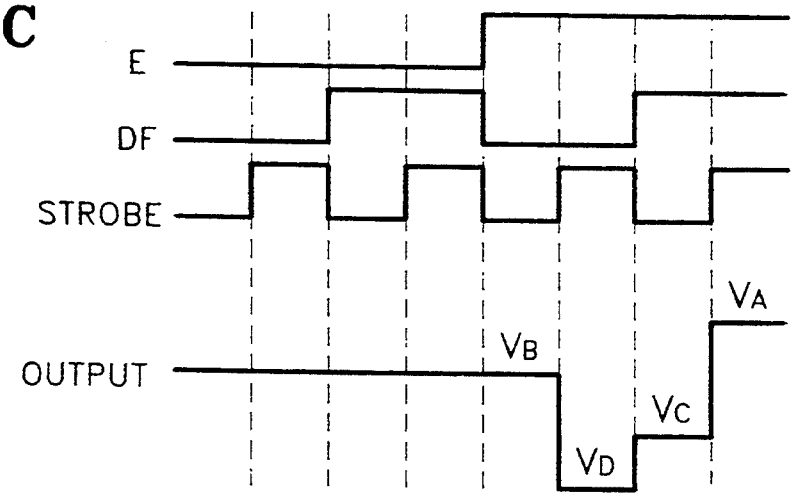

FIG. 5A
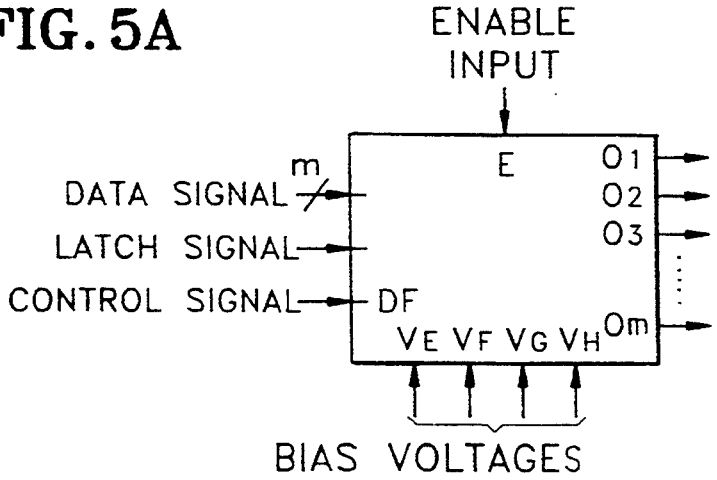
FIG. 5B
| E | DF | DATA | OUTPUT |
|---|---|---|---|
| H | L | L | VF |
| H | L | H | VE |
| H | H | L | VG |
| H | H | H | VH |
| L | X | X | VE |
FIG. 5C
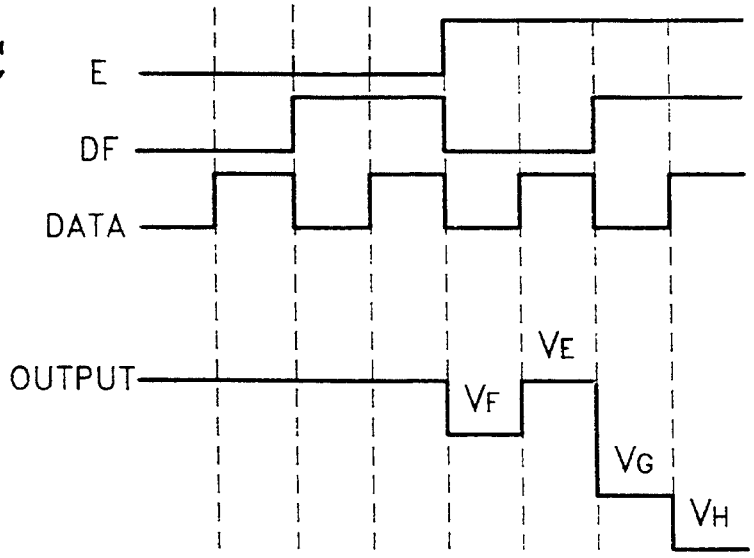

METHOD FOR DRIVING A FERROELECTRIC LIQUID CRYSTAL DISPLAYS AND BIAS VOLTAGE CIRCUIT THEREFOR

BACKGROUND OF THE INVENTION

The present invention relates to method for driving a ferroelectric liquid crystal displays, and more particularly to a driving method of a ferroelectric liquid crystal displays in a 1-frame reset mode, using a super twisted nematic (STN) driving IC, and a bias voltage circuit for generating a bias voltage supplied to the STN driving IC.

Ferroelectric liquid crystal displays which can present an image by a simple matrix driving without using active elements, have a characteristic that alignment of the liquid crystal is stored regardless of the interruption of the supplied power, so that contrast is not degraded even though duty is decreased. Also, while the switching of a nematic liquid crystal is carried out by a weak interaction ($\Delta\epsilon \cdot E^2/2$) between the dielectric anisotrophy ($\Delta\epsilon$) of the liquid crystal and the external electric field (E), the switching of a ferroelectric liquid crystal is carried out by a strong interaction (Ps·E) between the spontaneous polarization (Ps) of the liquid crystal and the external electric field. Accordingly, the response speed of the ferroelectric liquid crystal becomes to be measured in terms of microseconds, which is much faster than that of the nematic liquid crystal. Here, the basic characteristics of the ferroelectric liquid crystal display, which should be considered in the driving thereof, are as follows.

Generally, if a sustained DC component is applied to the liquid crystal, the liquid crystal deteriorates due to the electrochemical reaction. Also, the alignment orientation of the ferroelectric liquid crystal is changed due to the polarity of pulses. Therefore, a waveform of one period supplied to the liquid crystal during driving must have no DC component, and the data is displayed by selectively supplying one of both pulses of opposite polarities. Additionally, the pulse width supplied to the ferroelectric liquid crystal is restricted by the kind of liquid crystal, so that, when the pulse width is wide, the threshold voltage which causes state transition becomes low. In other words, the value obtained by multiplying threshold voltage $V_{th}$ by pulse width $\tau$ is a generally constant, and thus the pulse width must be lengthened to lower the driving voltage. However, to lengthen the pulse width undesirably requires a long period of time for expressing one pixel.

Meanwhile, the driving method of a ferroelectric liquid crystal display is classified into 5-pulse, 4-pulse, 3-pulse and 2-pulse techniques according to the number of the pulses required to display one pixel. Here, the 4-pulse and 2-pulse techniques are termed the 2-field method and 1-frame reset method, respectively, and will be described in detail with reference to FIGS. 1 and 2.

FIG. 1 illustrates a conventional 2-field method for displaying one picture by performing scanning twice, i.e., two fields wherein a first data state is designated in the first field, and a second data state is designated in the second field. However, in such a driving method, since the time required for expressing one picture becomes twice the field time, the displayed number of pictures in a unit time is halved, which impedes presentation of smoothly succeeding pictures. Furthermore, four pulses are required for displaying one pixel, which in turn narrows the pulse width, and raises the driving voltage in case of displaying many pixels within the unit time.

FIG. 2 illustrates 1-frame reset method, wherein one picture can be expressed by scanning once, and so that two pulses are required for expressing one pixel. Therefore, a larger number of pixels can be driven within a unit time. The voltage supplied to each electrode is one of three voltages. These features consequently simplify driving. However, an exclusive driving IC for driving the ferroelectric liquid crystal should be necessarily developed to realize the driving. That is, driving by way of the conventional STN driving IC becomes very complicated and is, for all practical purposes, impossible.

SUMMARY OF THE INVENTION

The present invention is based on a new pattern of waveforms of the composite voltages supplied to the liquid crystal cells in order to drive a ferroelectric liquid crystal display using a STN driving IC.

Therefore, it is a first object of the present invention to provide a method for driving the ferroelectric liquid crystal displays which can be realized using a general STN driving IC, while decreasing the number of pulses(or voltages) supplied to the liquid crystal cells during one pixel period.

It is a second object of the present invention to provide method for driving a common electrodes and segment electrodes in order to supply the composite voltages according to the above driving method to the ferroelectric liquid crystal cell of the displays.

It is a third object of the present invention to provide a method for driving bias pins and control pins of STN driving ICs, in order to make STN driving IC's output voltages according to above method for driving the common electrodes and segment electrodes method.

It is a fourth object of the present invention to provide a circuit for generating bias voltages supplied to bias pins of the general STN driving IC.

To achieve the first object of the present invention, there is provided a method for driving a ferroelectric liquid crystal displays which have a plurality of cells in matrix driving mode, comprising the steps of:

supplying a first composite voltage of a first polarity during the first half of pixel period, and supplying a second composite voltage of a second polarity which changes the alignment of the liquid crystal into a first state during the latter half of pixel period, to the liquid crystal cell which exists in the selected line and displays a first data;

supplying a third composite voltage of the first polarity which changes the alignment of the liquid crystal cell into a second state during the first half of pixel period, and supplying a fourth composite voltage of the second polarity which doesn't change the alignment of the liquid crystal cell during the latter half of pixel period, to the liquid crystal cell which exists in the selected line and displays the second data;

supplying a fifth composite voltage of the first polarity which doesn't change the alignment of the liquid crystal during the first half of pixel period, and supplying a sixth composite voltage of the second polarity which doesn't change the alignment of the liquid crystal during the latter half of pixel period, or supplying the sixth composite voltage during the first half of pixel period and supplying the fifth composite voltage during the latter half of pixel period, according to the data to be displayed, to the crystal cell which exists in the non-selected line.

To achieve the second object of the present invention, there is provided a method for driving the ferroelectric liquid crystal displays having common electrodes and segment electrodes and ferroelectric liquid crystal filled between the common and segment electrodes in the matrix driving mode, comprising the step of:

supplying a first voltage during the first half of pixel period and supplying a second voltage during the latter half of pixel period to the selected common electrode, and supplying a third voltage during the first half of pixel period and supplying a fourth voltage during the latter half of pixel period to the non-selected common electrodes, wherein the first voltage has the polarity opposite to that of the second voltage in case where the midpoint voltage of the third voltage and the fourth voltage is set to the reference voltage;

supplying a fifth voltage during the first half of pixel period and supplying a sixth voltage during the latter half of pixel period to the segment electrodes which display a first data, and supplying a seventh voltage during the pixel period to the segment electrodes which display a second data, wherein the fifth voltage has the polarity opposite to that of the sixth voltage in case where the seventh voltage is set to the reference voltage;

wherein, if the midpoint voltage of the third and fourth voltage is set the same with the seventh voltage, then the composite voltage of the second voltage and the sixth voltage changes the alignment of the liquid crystal into a first state, the composite voltage of the first voltage and the seventh voltage changes the alignment of the liquid crystal into a second state, and the composite voltage of the second voltage and the seventh voltage and the composite voltage of the voltages supplied to the segment electrodes and the third voltage or the fourth voltage don't change the alignment of the liquid crystal.

To achieve the third object of the present invention, there is provided a method for driving a ferroelectric liquid crystal displays having common electrodes connected to the output pins of the STN common driving IC, segment electrodes connected to the output pins of the STN segment driving IC and ferroelectric liquid crystal filled between the common electrodes and the segment electrodes in the matrix driving mode, comprising the step of:

supplying a frame sync signal to a scanning signal input pin of the STN common driving IC, and image data to a data input pin of the STN segment driving IC;

supplying voltages of Vw, Vd, −Vd and −Ve to first through fourth bias pins of the STN common driving IC, respectively, provided that the reference voltage level is zero volt;

supplying voltages of 2 Vd, 0, 0 and −2 Vd to fifth through eighth bias pins of the STN segment driving IC, respectively, provided that the reference voltage level is zero; and supplying "high" data during the first half of pixel period and "low" data during the latter half of pixel period, to control signal pins of the STN common driving and segment driving ICs, wherein voltage Vw changes the alignment of the liquid crystal into a second state, the voltage 2 Vd does not change the alignment of the liquid crystal, voltage −Ve does not change the alignment of the liquid crystal, and voltage −Ve−2 Vd changes the alignment of the liquid crystal into a first state.

To achieve the fourth object of the present invention, there is provided a circuit for generating bias voltages in the ferroelectric liquid crystal displays driven by means of a general STN driving IC's, comprising:

a first power supply;

a second power supply;

first through sixth resistors serially connected to one another between the first power supply and the second power supply;

a variable resistor whose one end is connected to the sixth resistor, and whose other end is connected to a second power supply; and first through sixth buffers, one end of each of the buffers being connected to a respective connection point of each the resistors, the connection point of the first resistor and first supply power and the outputs of the first through sixth buffers being sequentially connected to a first, fifth, second, sixth, seventh, third, eighth and then fourth bias pins of the STN driving IC, wherein the output voltage of the connection point of the first supply power and first resistor converts the alignment of the ferroelectric liquid crystal into a second state, provided the output voltage of the third buffer is the reference;

the output voltage of the first buffer is 2 Vd, that of the second buffer is Vd, that of the fourth buffer is −Vd, and that of fifth buffer is −2 Vd, provided that the output voltage of the third buffer is the reference and the voltage 2 Vd does not change the alignment of the ferroelectric liquid crystal; and the output voltage of the sixth buffer is −Ve, provided that the output voltage of the third buffer is the reference and a voltage −Ve does not change the alignment of the ferroelectric liquid crystal but a voltage −Ve−2 Vd changes the alignment of the ferroelectric liquid crystal into a first state.

Briefly speaking, the present invention provides the desirable waveforms of composite voltages to display one picture by scanning once and signals to be applied to respective pins of STN driving IC's such that such composite voltages should be applied to liquid cells through common electrodes and segment electrodes connected to STN driving IC's. Also, the present invention provides a circuit for generating voltages applied to bias pins of STN driving IC's.

This method is different from a prior art disclosed in U.S. Pat. No. 4,870,398, in that the number of pulses required for one pixel period is decreased from three to two, and the bias voltages are adjustable. Additionally, as compared with a prior art disclosed in Japan Patent Publication No. 62-45535 by Canon Co., the technique of displaying one picture by a single scanning operation is the same, but the driving waveforms are different and the present invention easily performs the driving operation by means of a general STN driving IC, while the prior art cannot practically use such an IC.

BRIEF DESCRIPTION OF THE DRAWINGS

The above objects and other advantages of the present invention will become more apparent by describing in detail a preferred embodiment thereof with reference to the attached drawings in which:

FIGS. 4A, 4B and 4C are views illustrating a common electrode driving IC for driving a general STN liquid crystal displays;

FIGS. 5A, 5B and 5C are views illustrating a segment electrode driving IC for driving a general STN liquid crystal displays;

DETAILED DESCRIPTION OF THE INVENTION

Figure 1:
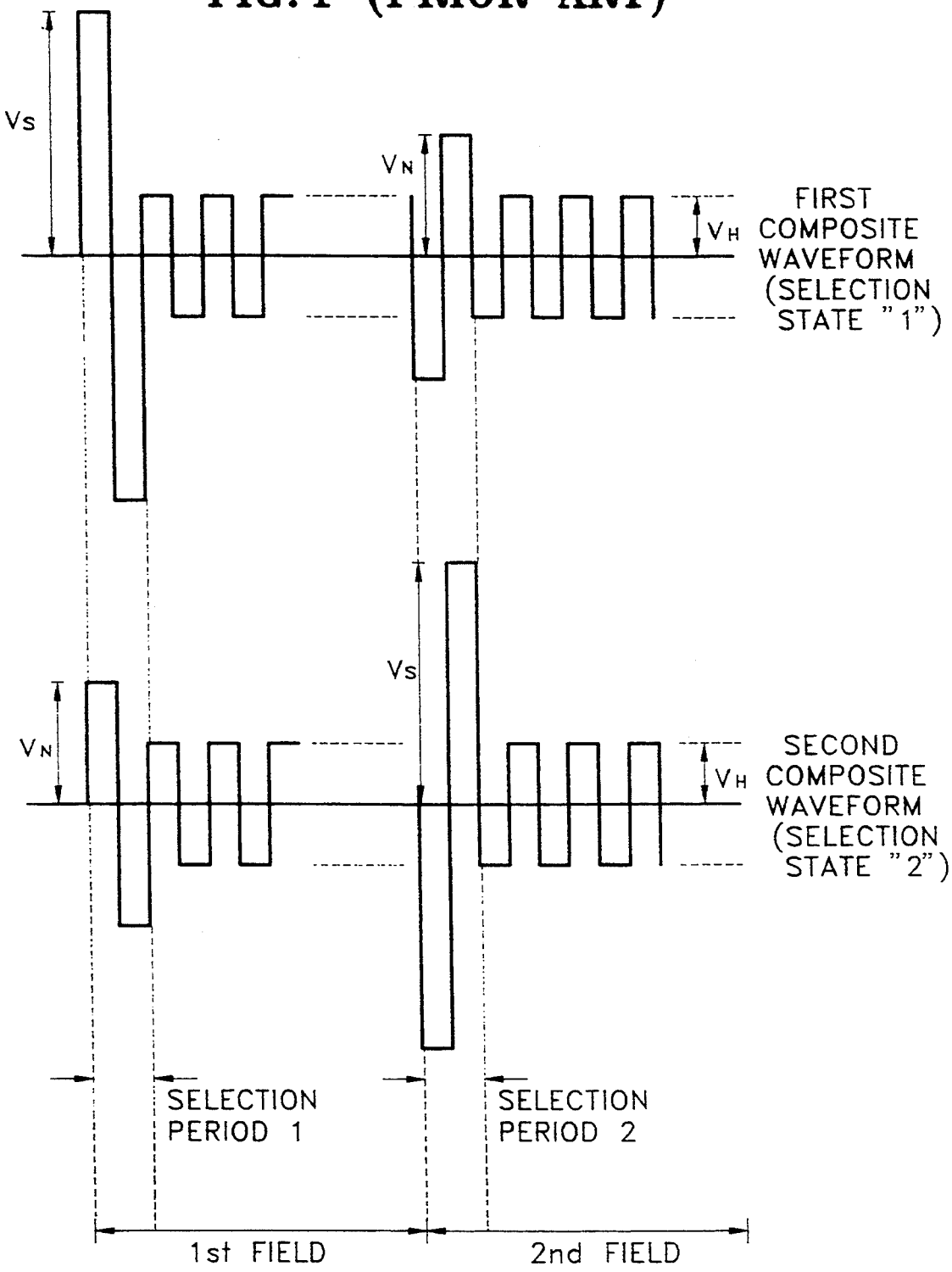
FIG. 1 (PRIOR ART)
FIG. 1 shows waveforms for driving a ferroelectric liquid crystal displays by means of a conventional 2-field method.
Figure 2:
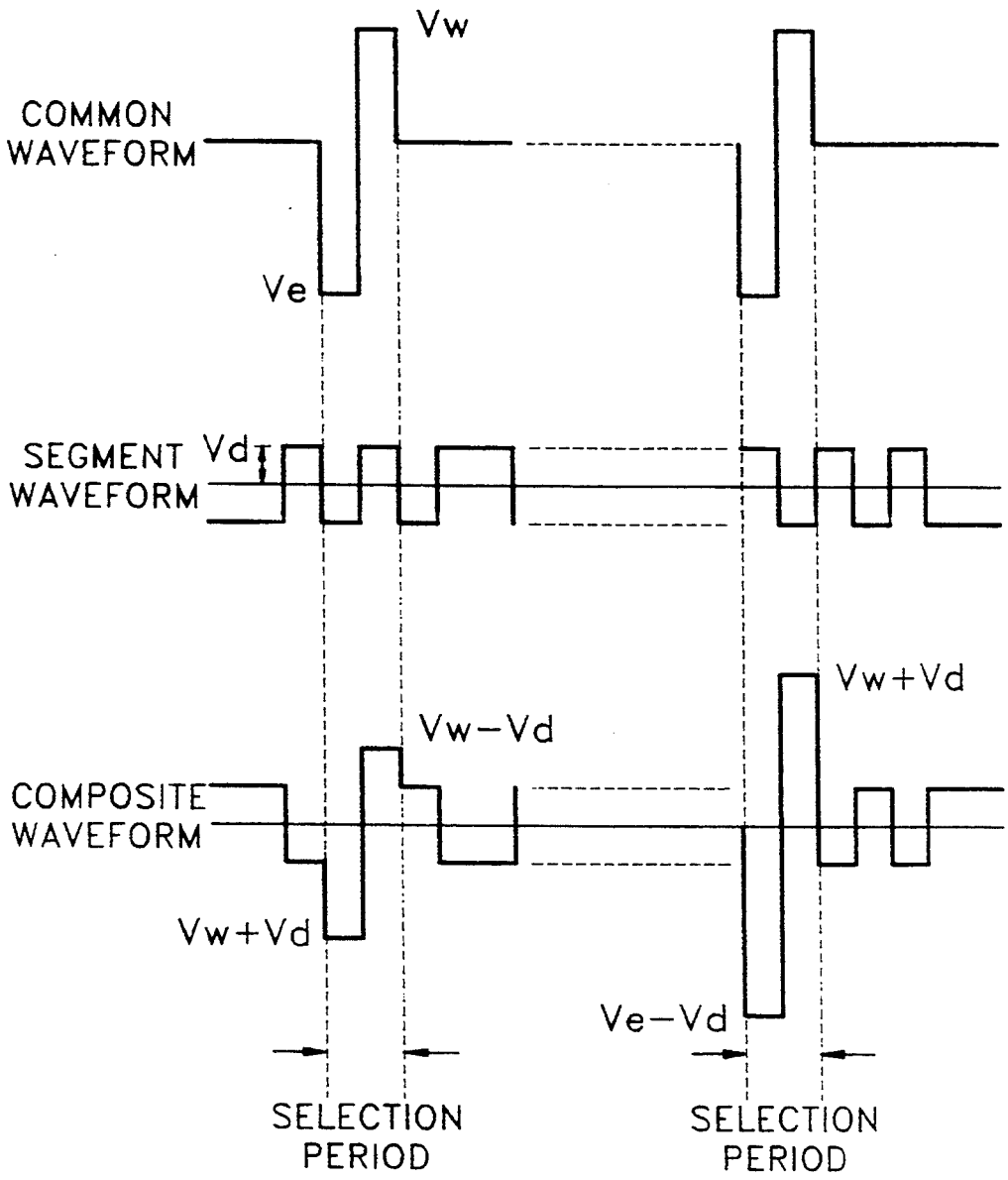
FIG. 2 (PRIOR ART)
FIG. 2 shows waveforms or driving a ferroelectric liquid crystal displays by means of a conventional 1-frame reset method.
Figure 3:
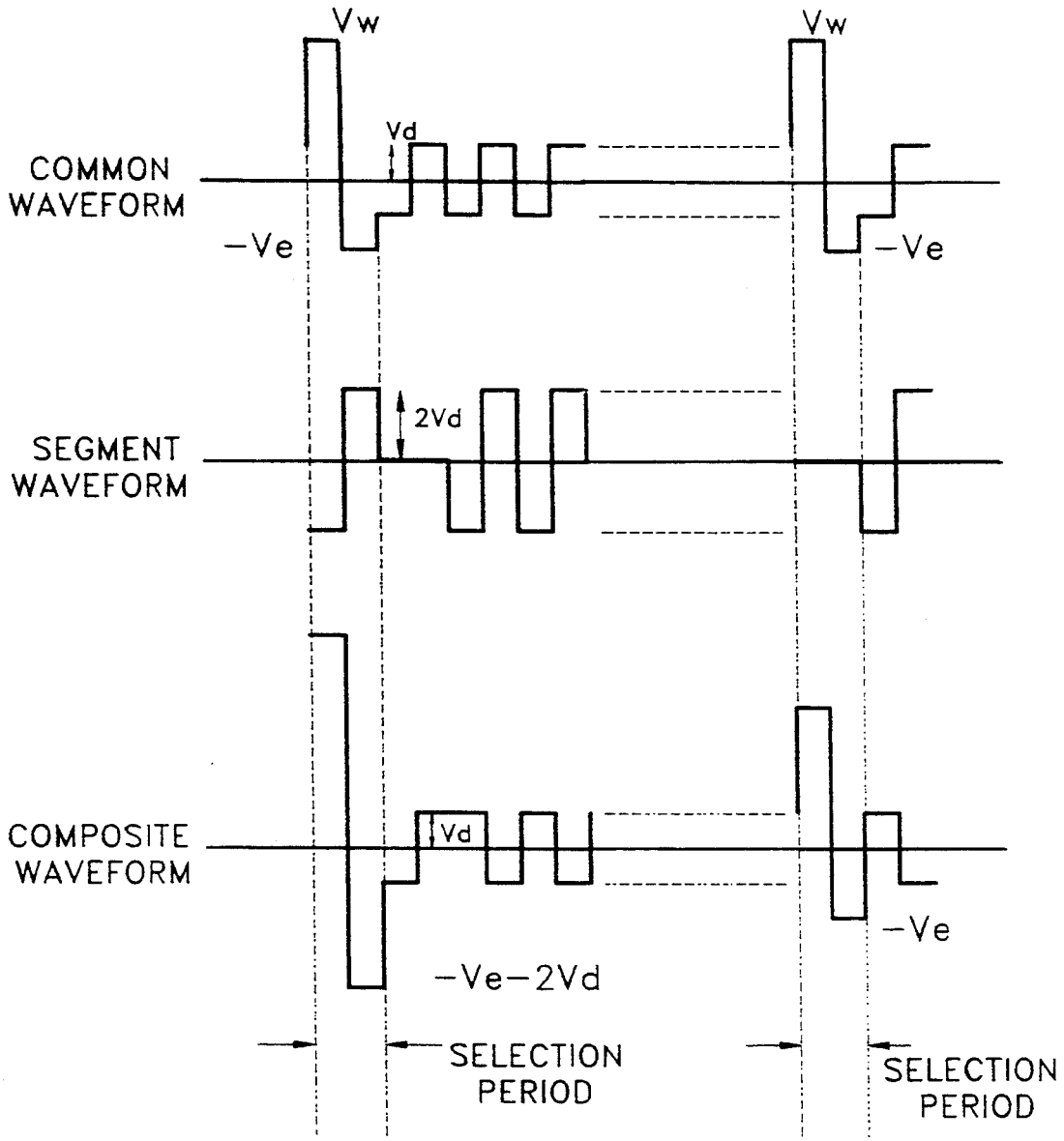
FIG. 3 shows waveforms for driving a ferroelectric liquid crystal displays by means of a 1-frame reset method according to the present invention.

FIG. 3 shows waveforms for driving a ferroelectric liquid crystal displays by means of an 1-frame reset method according to the present invention. More specifically, a waveform of a common electrode supplied with a driving voltage according to a scanning signal, a waveform of a segment electrode supplied with a driving voltage according to image data, and a composite waveform supplied to a cell, are respectively shown.

First, the common electrode waveform can be classified into two types: one applied during a selection, and the other applied during a non-selection period. In other words, a first voltage Vw is supplied during the first half of pixel period and a second voltage −Ve is supplied during the latter half of the pixel period, to the common electrode selected according to the scanning signal. Here, the first voltage Vw changes the alignment of the liquid crystal into a second state, and the second voltage −Ve does not change the alignment thereof. On the other hand, a third voltage is supplied during the first half of pixel period and a fourth voltage is supplied during the latter half of pixel period, to the common electrodes non-selected according to the scanning signal. Here, if the midpoint voltage of the third voltage and fourth voltage is zero[volt], then the third voltage and fourth voltage can be designated −Vd and Vd respectively, and the first and second voltages have opposite polarities based on this reference; with the fourth voltage having the same polarity as that of the second voltage. Also, second voltage −Ve must be regulated so that the alignment of the ferroelectric liquid crystal should be changed into the first state at the voltage −Ve−2 Vd, and shouldn't be changed within or at voltage −Ve.

The waveform of the segment electrode is explained below.

A fifth voltage is supplied during the first half of pixel period and a sixth voltage is supplied during the latter half of pixel period, to the segment electrodes which display a first data (bit "1"). Meanwhile, a seventh voltage is applied during the pixel period to the segment electrodes which display a second data (bit "0"). If the seventh voltage is set as the reference, the fifth voltage and sixth voltage have opposite polarities, which can be respectively designated −2 Vd and 2 Vd.

The composite waveform shown in FIG. 3 can be obtained by setting the midpoint voltage of the third voltage and the fourth voltage to be the same as the seventh voltage. In more detail, a first composite voltage having a first polarity supplied during the first half of pixel period and a second composite voltage having a second polarity is supplied during the latter half of pixel period, to the liquid crystal cell which exists in the selected line and displays the first data. Here, in order to change the alignment of the ferroelectric liquid crystal into the first state by means of the second composite voltage, the second voltage supplied to the common electrode and the sixth voltage supplied to the segment electrode are adjusted. Also, a third composite voltage having the first polarity is supplied during the first half of pixel period and a fourth composite voltage having the second polarity which does not change the alignment of the liquid crystal is supplied during the latter half of pixel period, to the liquid cell which exists in the selected line and displays the second data. Here, the alignment of the ferroelectric liquid crystal is changed into the second state by means of the third composite voltage.

Meanwhile, a fifth composite voltage having the first polarity which doesn't change the alignment of the liquid crystal is applied during the first half of pixel period, and a sixth composite voltage having the second polarity which doesn't change the alignment of the liquid crystal is applied during the latter half of pixel period, or vice versa (or the sixth composite voltage is applied during the first half of pixel period and the fifth composite voltage is applied during the latter half of pixel period), according to data, to the liquid crystal cell which exists in the non-selected line. Here, the fifth voltage is Vd and the sixth voltage is −Vd.

FIGS. 4A, 4B and 4C are illustrations for explaining a common electrode driving IC for driving a general STN liquid crystal displays. Here, FIG. 4A shows the construction of the common electrode driving IC chip including: an input pin for receiving a sync signal commonly referred to as a frame signal; bias pins $V_A$, $V_B$, $V_C$ and $V_D$ for inputting bias voltages; a control signal pin DF for receiving a control signal; a latch signal pin for receiving a latch signal; and output pins $O_1$–$O_n$. Internally, the chip is provided with an n-bit shift register for receiving the frame signal and then shifting the frame signal according to the supplied latch signal, whose outputs serve as scan signals for sequentially selecting one common electrode among n common electrodes (corresponding to output pins $O_1$–$O_n$). At this time, the relationship between the voltages applied to the bias pins can be written: $V_A \geqq V_B \geqq V_C \geqq V_D$.

When considering the truth table shown in FIG. 4B, one bias voltage among voltages supplied to bias pins $V_B$, $V_D$, $V_C$ and $V_A$) is selected according to control signal applied to control signal pin DF, the scanning signal and an enable signal and then internally transferred to the output pin in order to be output. FIG. 4C is a waveform representation of the truth table of the common driving IC.

FIGS. 5A, 5B and 5C illustrate a segment driving IC for driving a general STN liquid crystal displays and the operation thereof. Here, FIG. 5A shows the construction of the segment driving IC chip including: a data pin supplied with image dam; a latch signal pin supplied with a latch signal; a control signal pin DF supplied with a control signal; bias pins $V_E$, $V_F$, $V_G$ and $V_H$ supplied with bias voltages; and output pins $O_1$–$O_m$. At this time, each output voltage is determined according to the control signal supplied to control signal pin DF, the supplied data signal and the enable signal, as shown in the truth table of FIG. 5B. In more detail, when the enable signal is high (H), voltages supplied to bias voltage pins $V_F$, $V_E$, $V_G$ and $V_H$ are selectively output according to the signal supplied to control signal pin DF and the data signal. FIG. 5C is a waveform representation of the truth table of the segment driving IC.

Figure 6A:
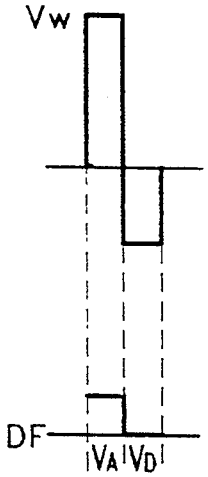
FIGS. 6A and 6B are illustrations showing the extraction of bias voltages for the common electrode driving IC of FIG. 4A.
Figure 6B:
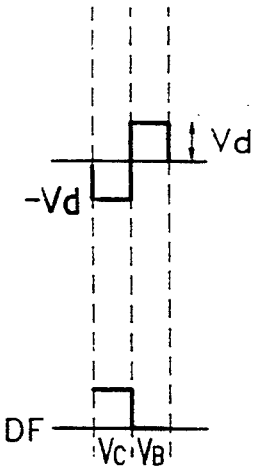

FIGS. 6A–6D illustrate the extractions of bias voltages which should be supplied to bias pins of driving IC and control signals which should be supplied to control signal pins DF. Here, FIG. 6A shows the first voltage Vw and the second voltage −Ve applied to the common electrode selected during a pixel period (or when the scanning signal is "high") in the upper part and shows the control signal which is "high" during the first half of pixel period and is "low" during the latter half of pixel period and bias pins connected to the output pin according to such this scanning signal and control signal in the lower part. FIG. 6B shows the third voltage −Vd and the fourth voltage Vd applied to the common electrode non-selected during a pixel period (or when the scanning signal is "low") in the upper part and shows the control signal which is "high" during the first half of pixel period and is "low" during the latter half of pixel period and bias pins connected to the output pin according to such this scanning signal and control signal in the lower part.

Figure 6C:
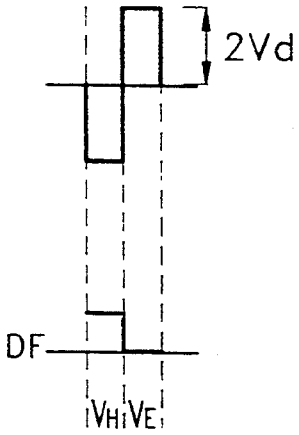
FIGS. 6C and 6D are illustrations showing the extraction of bias voltages for the segment electrode driving IC of FIG. 5A.
Figure 6D:
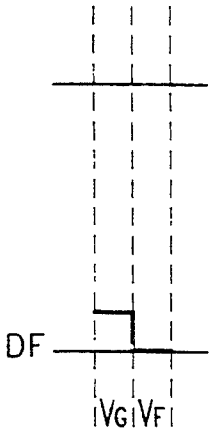

In other words, bias voltage applied to the bias pin $V_A$ is transferred during the first half of pixel period and bias voltage applied to the bias pin $V_D$ is transferred during the latter half of pixel period to the common electrode selected, while bias voltage applied to the bias pin $V_C$ is transferred during the first half of pixel period and bias voltage applied to the bias pin $V_B$ is transferred during the latter half of pixel period to the common electrode non-selected. Therefore, the first voltage Vw is supplied to the bias pin $V_A$, and the second voltage −Ve is supplied to the bias pin $V_D$, and the third voltage −Vd is supplied to the bias pin $V_C$, and the fourth voltage Vd is supplied to the bias pin $V_B$. In this manner, FIG. 6C and FIG. 6D show the voltages supplied to the segment electrode according to the data and the bias pins connected to the output pin when the control signal is "high" during the first half of pixel period and "low" during the latter half of pixel period. With reference to the FIG. 6C and FIG. 6D, to the segment electrode which displays the first data, the voltage applied to the bias pin $V_H$ is transferred during the first half of pixel period and the voltage applied to the bias pin $V_E$ is transferred during the latter half of pixel period, while, to the segment electrode which displays the second data, the voltage applied to the bias pin $V_G$ is transferred during the first half of pixel period and the voltage applied to the bias pin $V_F$ is transferred during the latter half of pixel period. Consequently, the respective bias voltages applied to the bias pins become $V_E=2$ Vd, $V_F=$Vref, $V_G=$Vref, and $V_H=-2$ Vd (where Vref is zero). Here, the relationships of these voltages are the same as those described with reference to FIG. 3.

Figure 7A:
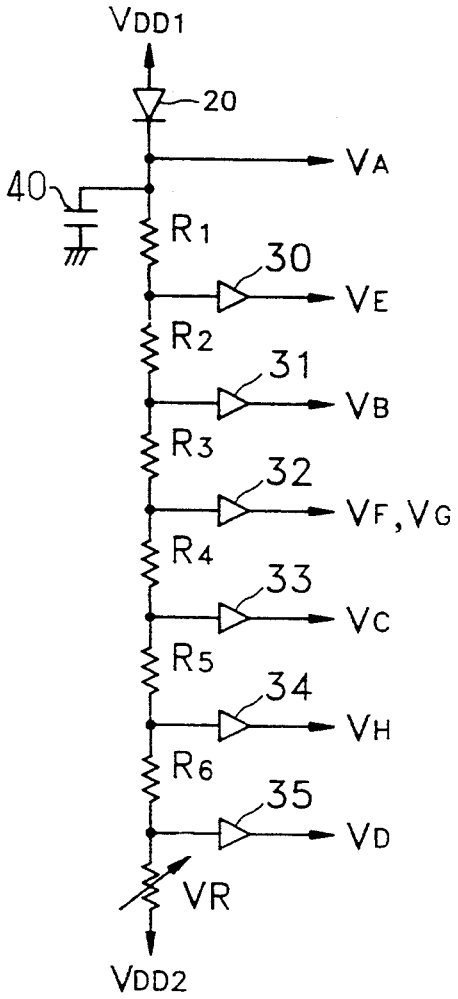
FIGS. 7A and 7B show circuit diagrams for generating voltages supplied to each bias pins of FIGS. 4 and 5.
Figure 7B:
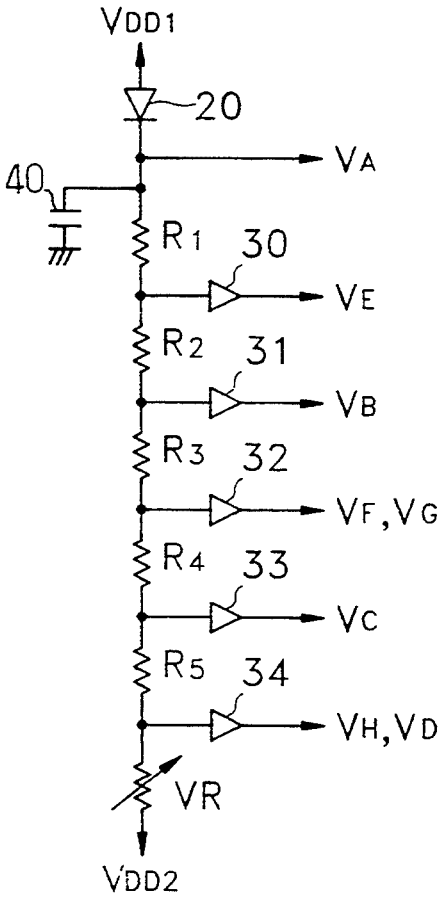

FIG. 7A and 7B show circuits for generating bias voltages supplied to all the bias pins shown in both FIGS. 4A through 5C. Here, the above voltages supplied to the bias pins $V_A$–$V_H$ are obtained by dividing the potential difference of two power supplies using at least six resistors. In FIG. 7A, one embodiment of a bias voltage circuit includes: a first through sixth resistors $R_1$–$R_6$, a variable resistor VR, six buffers 30–35, a capacitor 40 and a diode 20. Each resistance is adjusted (selected) to provide outputs in accordance with the relationships of the respective voltages explained in FIG. 3. Six buffers 30–35 function for stably supplying the bias voltages, and diode 20 blocks reverse current. Capacitor 40 eliminates high frequency components, and variable resistor VR adjusts the overall voltage range to obtain optimum contrast of the ferroelectric liquid crystal display. At this time, if the voltages are the same as shown in FIG. 3, the resistance of the first resistor is twice that of the second resistor, and the resistances of second through fifth resistors are the same. Also, if the second voltage is −2 Vd in FIG. 3, the resistance of the sixth resistor becomes "zero" as shown in FIG. 7B, and the bias pin $V_D$ can be connected to fifth buffer 34. In other words, in the bias voltage circuit suggested in the present invention, the voltages supplied to the bias pins can be obtained by dividing the potential difference between first and second power supplies $V_{DD1}$ and $-V_{DD2}$ using at least six resistors. The ranges of the bias voltages are determined by adjusting the resistances of the resistors such that, as shown in FIG. 3, the change of the FLC (ferroelectric liquid crystal) alignment to display the first data is performed during the latter half of pixel period, and the change thereof to display the second data is performed during the first half of pixel period.

As described above, the present invention provides a method for driving a ferroelectric liquid crystal display and the bias voltage circuit thereof, using a generally utilized STN driving IC, so that a special IC for driving a ferroelectric liquid crystal display need not be developed. Therefore, the ferroelectric liquid crystal display can be driven economically. Furthermore, both first and second data are displayed within one frame, and the number of pulses required for one pixel period is decreased to two. As a result, the addressing time can be shortened, thereby preventing the flickering of a picture when displaying a moving image.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A method for driving a ferroelectric liquid crystal displays which have a plurality of cells in matrix driving mode comprising the steps of:

supplying a first composite voltage of a first polarity during the first half of pixel period, and supplying a second composite voltage of a second polarity which changes the alignment of the liquid crystal into a first state during the latter half of pixel period, to the liquid crystal cell which exists in the selected line and displays a first data;

supplying a third composite voltage of said first polarity which changes the alignment of the liquid crystal cell into a second state during the first half of pixel period, and supplying a fourth composite voltage of the second polarity which doesn't change the alignment of the liquid crystal cell during the latter half of pixel period, to the liquid crystal cell which exists in the selected line and displays the second data; and supplying a fifth composite voltage of said first polarity which doesn't change the alignment of the liquid crystal during the first half of pixel period, and supplying a sixth composite voltage of said second polarity which doesn't change the alignment of the liquid crystal during the latter half of pixel period, or supplying sixth composite voltage during the first half of pixel period and supplying said fifth composite voltage during the latter half of pixel period, in dependence upon the data displayed, to the crystal cell which exists in the non-selected line, wherein said fourth composite voltage is −2 Vd, provided that said sixth composite voltage is −Vd.

2. A method for driving a ferroelectric liquid crystal displays as claimed in claim 1, wherein said fifth composite voltage and said sixth composite voltage are between said third composite voltage and said second composite voltage.

3. A method for driving the ferroelectric liquid crystal displays having common electrodes and segment electrodes and ferroelectric liquid crystal filled between said common and segment electrodes in the matrix driving mode, comprising the steps of:

supplying a first voltage during the first half of pixel period and supplying a second voltage during the latter half of pixel period to the selected common electrode, and supplying a third voltage during the first half of pixel period and supplying a fourth voltage during the latter half of pixel period to the non-selected common electrodes, wherein said first voltage has the polarity opposite to that of the second voltage in case of the midpoint voltage of said third voltage and said fourth voltage set to the reference;

supplying a fifth voltage during the first half of pixel period and supplying a sixth voltage during the latter half of pixel period to the segment electrodes which display a first data, and supplying a seventh voltage during the pixel period to the segment electrodes which display a second data, wherein said fifth voltage has the polarity opposite to that of said sixth voltage in case of said seventh voltage set to the reference;

wherein, if the midpoint voltage of said third voltage and said fourth voltage is set the same with said seventh voltage, then the composite voltage of said second voltage and said sixth voltage changes the alignment of said liquid crystal into a first state, the composite voltage of said first voltage and said seventh voltage changes the alignment of said liquid crystal into a second state, and the composite voltage of said second voltage and said seventh voltage and the composite voltage of said voltages supplied to said segment electrodes and said third voltage or said fourth voltage don't change the alignment of said liquid crystal.

4. A method for driving a ferroelectric liquid crystal displays as claimed in claim 3, wherein, said third voltage and said fourth voltage have the same difference from said reference voltage but opposite polarities.

5. A method for driving a ferroelectric liquid crystal displays as claimed in claim 3, wherein, when the potential difference of said third voltage or fourth voltage from said reference voltage level is Vd, said fifth voltage and said sixth voltage are of opposite polarities and each has potential difference of 2 Vd from said seventh voltage level.

6. A method for driving a ferroelectric liquid crystal displays as claimed in claim 3, wherein, when the potential difference of said third voltage or said fourth voltage from said reference voltage level is Vd, said second voltage has a difference of −2 Vd from said reference voltage level.

* * * * *